US008727157B2

(12) United States Patent
Rances

(10) Patent No.: US 8,727,157 B2
(45) **Date of Patent: *May 20, 2014**

(54) VERSATILE PARTITIONED CONTAINER RELATED APPLICATIONS

(71) Applicant: Renato M Rances, Northridge, CA (US)

(72) Inventor: Renato M Rances, Northridge, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/691,471

(22) Filed: Nov. 30, 2012

(65) Prior Publication Data

US 2013/0098908 A1 Apr. 25, 2013

Related U.S. Application Data

(63) Continuation of application No. 12/890,572, filed on Sep. 24, 2010, now Pat. No. 8,342,346.

(60) Provisional application No. 61/350,009, filed on May 31, 2010.

(51) Int. Cl.

| | |
|---|---|
| ***B65D 6/28*** | (2006.01) |
| ***B65D 8/18*** | (2006.01) |
| ***A47G 19/00*** | (2006.01) |
| ***B65D 21/02*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |

(52) U.S. Cl.

USPC ..... 220/4.26; 220/23.83; 220/23.86; 220/529; 220/554

(58) Field of Classification Search

USPC ..... 220/4.26, 23.83, 23.86, 529, 554

See application file for complete search history.

(56) References Cited

U.S. PATENT DOCUMENTS

| | | | | |
|---|---|---|---|---|
| 2,326,414 | A | 8/1943 | Thompson | |
| 2,328,543 | A * | 9/1943 | Bauman | 206/499 |
| 4,078,686 | A | 3/1978 | Karesh | |
| 4,444,324 | A | 4/1984 | Grenell | |
| 4,498,832 | A | 2/1985 | Corville | |
| 4,598,832 | A | 7/1986 | Alonso | |
| 6,199,699 | B1 | 3/2001 | Eastman | |
| 2010/0200438 | A1 * | 8/2010 | Davies | 206/223 |

FOREIGN PATENT DOCUMENTS

| | | |
|---|---|---|
| WO | WO03000560 | 1/2003 |

* cited by examiner

*Primary Examiner* — Fenn Mathew
*Assistant Examiner* — Andrew T Kirsch
(74) *Attorney, Agent, or Firm* — George P. White

(57) ABSTRACT

A versatile, small-mouthed container is readily disassemblable and reassemblable to provide direct access to its internal cavity. Portions are mutually sealingly connectable by an annular coupling ring with two sets of threads, one each respectively to mate with threads on an upper and a lower cylindrical container portion. More than two cylindrical portions and more than one coupling ring can allow assemblage of larger containers and of containers of reconfigurable capacity. Some coupling rings provide for fluid communication between adjacent body portions and others provide a degree of blockage. Inserting or removing a partitioning disk into the ring can change a ring's degree of blockage. Various partitioning disks are provided with different degrees and types of blockage, when not deployed, the disks can be retained at the base of the container. Recessed latches prevent inadvertent opening at specific coupling interfaces.

4 Claims, 11 Drawing Sheets

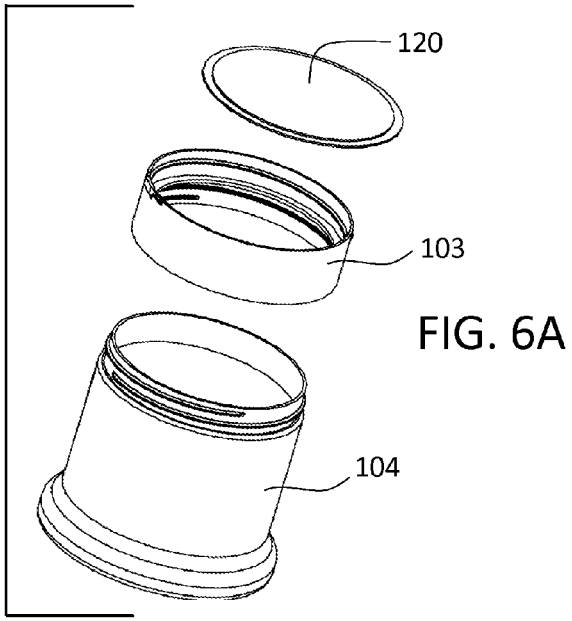
FIG. 6A
FIG. 6C
FIG. 6B
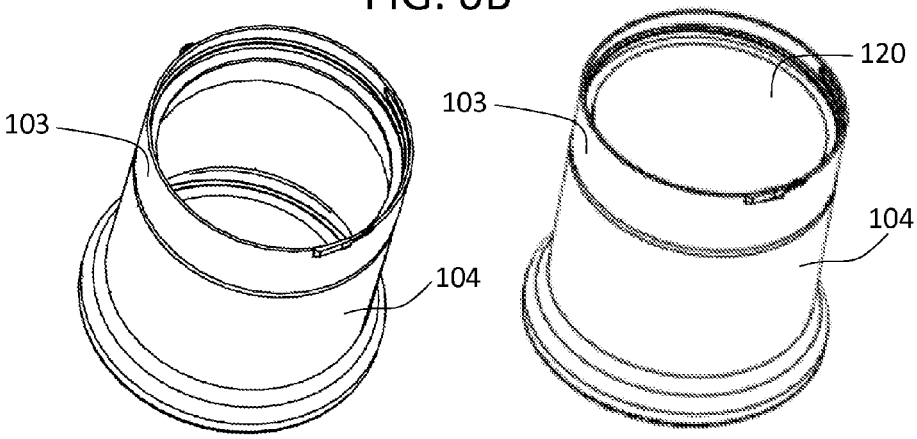

VERSATILE PARTITIONED CONTAINER RELATED APPLICATIONS

RELATED APPLICATIONS

This application is a continuation of application Ser. No. 12/890,572 filed Sep. 24, 2010, which in turn claims the benefit of U.S. provisional application 61/350,009 filed May 31, 2010. These two applications are hereby incorporated herein by reference in their entirety.

FIELD

This is related to the field of multi-compartment containers particularly those that are user-reconfigurable.

BACKGROUND

There has been an increased use in reusable containers, particularly among those who are concerned about the environmental impact of disposable plastic containers or those who are possibly concerned about chemicals from which the plastic is made. A wide variety of containers and vessels are known. A water bottle for example generally has a cylindrical shape, necking to a smaller dispensing opening for convenient drinking. These bottles have many drawbacks. One example is the difficulty of putting ice in a water bottle. Ice cubes are generally much larger than the opening designed for drinking.

SUMMARY

Embodiments consistent with the teachings herein can include containers that are compartmentalized. Some versions have a small dispensing opening with a removable cap in an upper portion for direct drinking and have a lower portion as well. The upper and lower portions can be joined in a sealing manner. Separating an upper portion from a lower portion at a wide region of the container can be a convenient way to allow ice cubes too large for the dispensing opening to be placed directly into the container's cylindrical body. Further, embodiments described herein can have a separable annular coupling ring to mutually attach two adjacent portions in a sealing manner.

It is preferable that a user's twisting action to remove a cap not also be a motion that would tend to separate one portion from another portion, leading to spilling the contents. Versions consistent with the teachings herein can provide one or more latches associated with the coupling ring to prevent inadvertent spilling.

Embodiments consistent with these teachings can have three or more compatible, optionally attachable sections interconnectable by two or more coupling rings. These versions can provide a capability to increase and decrease the total volume available to hold contents by omitting or adding one or more sections from the assembled container. Also, a coupling ring can optionally include a partition providing for two adjacent sections to form distinct cavities isolated from one another. In some versions the bottom of an upper portion can be optionally sealed in order to create a container configuration to hold two distinct liquids or possibly an upper portion holding a liquid and one or more lower portions holding solid matter. An optionally insertable disc that is readily installable and removable by the user can form the partition. Some embodiments taught herein can have a retaining area on the base of the lowest portion of the container for retaining these discs when not in use as partitions.

BRIEF OVERVIEW OF THE DRAWINGS

FIG. 6A is a perspective, exploded view of the base, a coupling ring, and a partitioning disk;

FIG. 6B is a perspective view of the base and a coupling ring of the container of FIG. 1A;

FIG. 6C is the apparatus in the view of FIG. 6B with a partitioning disk in place;

DETAILED DESCRIPTION OF EXAMPLE EMBODIMENTS

In conjunction with the included drawings this detailed description is intended to impart an understanding of the teachings herein and not to define their metes and bounds.

A First Example Container

Figure 1A:
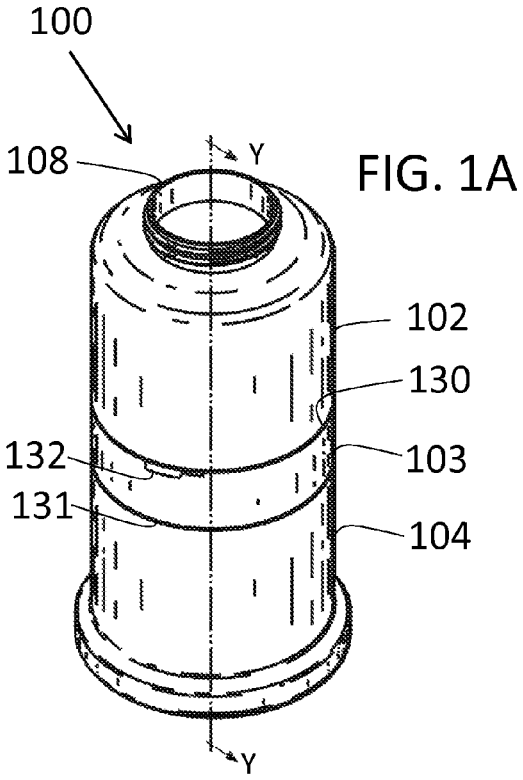
FIG. 1A shows an elevation view of an example container with two portions.
Figure 1B:
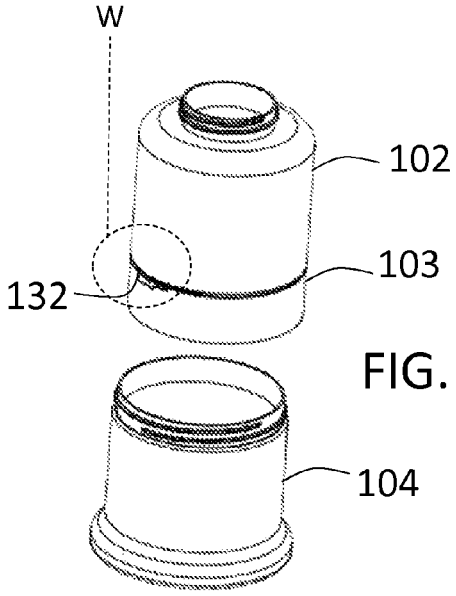
FIG. 1B shows the container of FIG. 1A with the lower portion unscrewed from the coupling ring.
Figure 2:
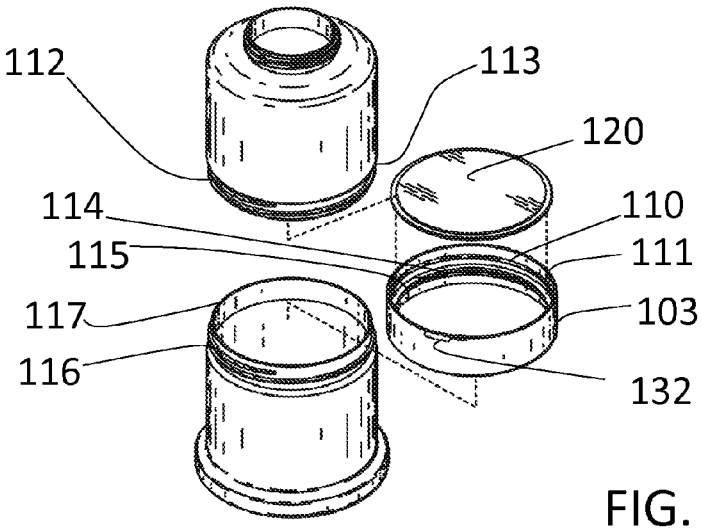
FIG. 2 illustrates a perspective exploded view of the container of FIG. 1A.

This example embodiment is a container 100 that is separable at a plane about halfway up from the bottom and parallel to the bottom as seen assembled in FIG. 1A and exploded in FIG. 1B. It has a dispensing opening 108, an upper cylinder 102, an annular coupling ring 103, and a lower, base cylinder 104. The internal threads 110 on the upper rim 111 of the coupling ring are complementary to the external threads 112 on the lower rim 113 of the upper cylinder as seen in FIG. 2. In a similar relationship, the internal threads 114 at the lower rim 115 of the coupling ring are mate-able with the external threads 116 on the upper rim 117 of the base cylinder. The upper and lower portions are separatable and reconnectable at two distinct joints 130 131. Containers of this type could be made of plastic, aluminum, or other suitable materials.

The connection 130 formed by the upper cylinder 102 and the coupling ring 103 and the other connection 131 formed by the coupling ring and the base cylinder 104 are both sealing matings. The threaded connection between the base cylinder and the coupling ring is prevented from accidental un-mating by a latch 132. This recessed latch reduces the likelihood of a user dis-assembling the container at a point other than at the intended connection or joint.

Figure 3B:
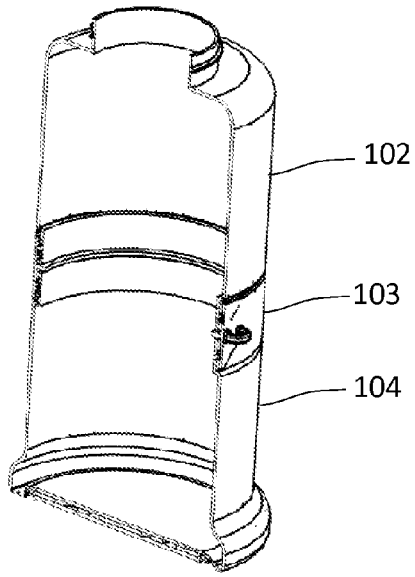
FIG. 3B is a cross-section of the container of FIG. 1A long the line Y-Y.
Figure 3A:
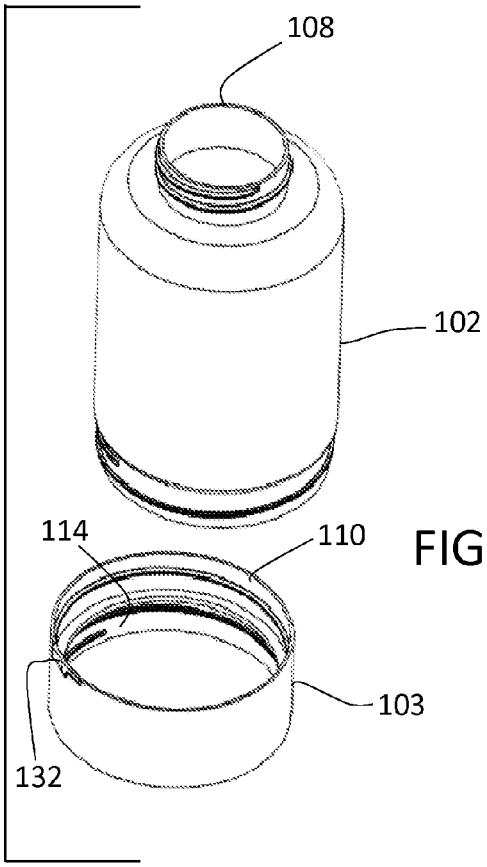
FIG. 3A shows an enlarged portion of the container of FIG. 1A in perspective, illustrating its coupling ring.
Figure 4:
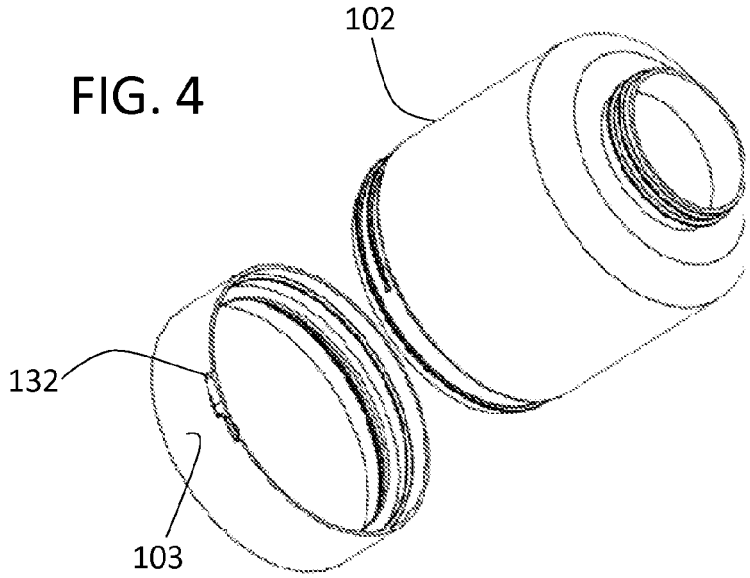
FIG. 4 is similar to FIG. 3A, but from an alternate perspective point.

In FIG. 3A the upper cylinder 102 with its dispensing opening 108 is shown poised above the coupling ring 103 and allows a view of the coupling ring's upper 110 and lower threads 114. FIG. 3B is a sectional view showing the unit assembled while FIG. 4 is enlarged to particularly show the latch mechanism of this first example container.

Improved access to the cavity of a cylindrical container with a small dispensing opening can afford ease of cleaning and also ease of introducing a large solid object, ice for example, to the container's cavity. For this purpose a single openable joint might suffice. The present example has additional capabilities that benefit from its dual-connection arrangement. The upper cylinder 102 and base cylinder 104, when coupled, normally form a single chamber. Optionally, this can be separated into two independent chambers for holding two different contents. FIG. 6A shows a coupling ring 103 with a partitioning disk 120 above it. Also shown is the base cylinder 104 poised to be screwed in to the annular coupling ring 103.

The base cylinder 104 might contain a second liquid, a reserve supply of the first liquid or might contain a solid. Even two solids such as yogurt and strawberries for example may be placed in the separate chambers. Holding both water and trail mix or holding milk and cereal for example, are applications that could benefit this embodiment. To access the cereal while not disrupting the milk, the container is disassembled at the lower joint of the coupler. If it were unintentionally disconnected at the upper joint instead, the seal at the base of the upper chamber would be opened and milk would spill out of the bottom of the upper cylinder. To prevent this unfortunate occurrence, the upper and lower joints of the coupling ring have disparate activation actions.

Figure 5:
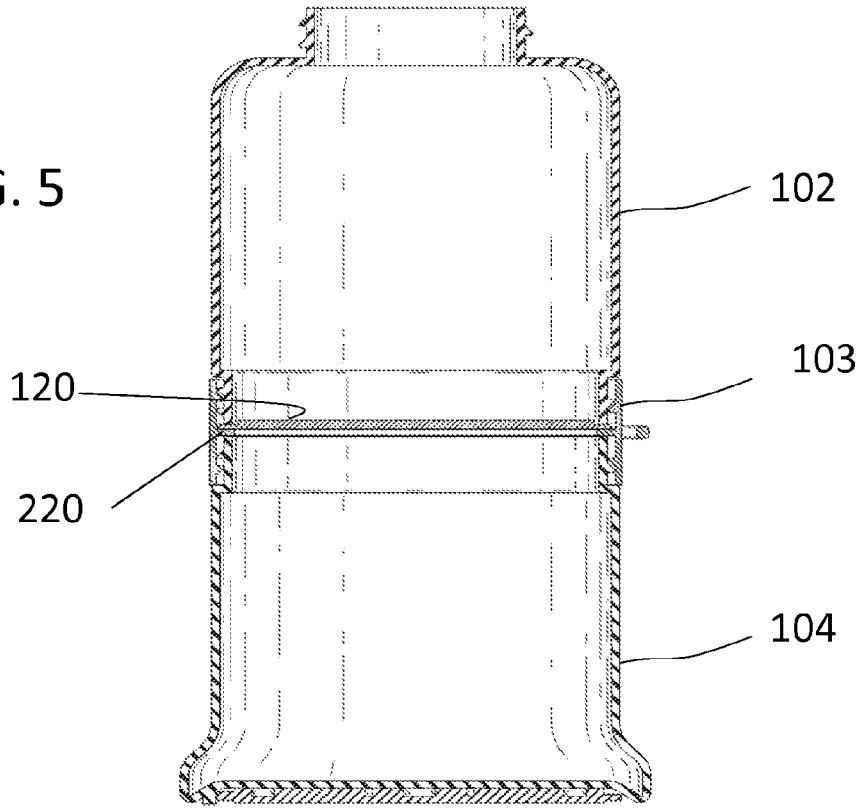
FIG. 5 is a sectional view of the bottle of FIG. 1A along the line Y-Y.

FIG. 5 is a sectional view that shows the mutual engagement of the upper portion 102, coupling ring 103, and lower portion 104 of a bottle. A solid partition 120 is seen captured between the lower rim of the upper portion and a stop lip 220 of the coupling ring.

FIGS. 6B and 6C show the base segment 104 of the container attached to the coupling ring 103. In 6C a solid partitioning disk 120 is seen resting in the upper portion of the coupling ring.

Figure 7:
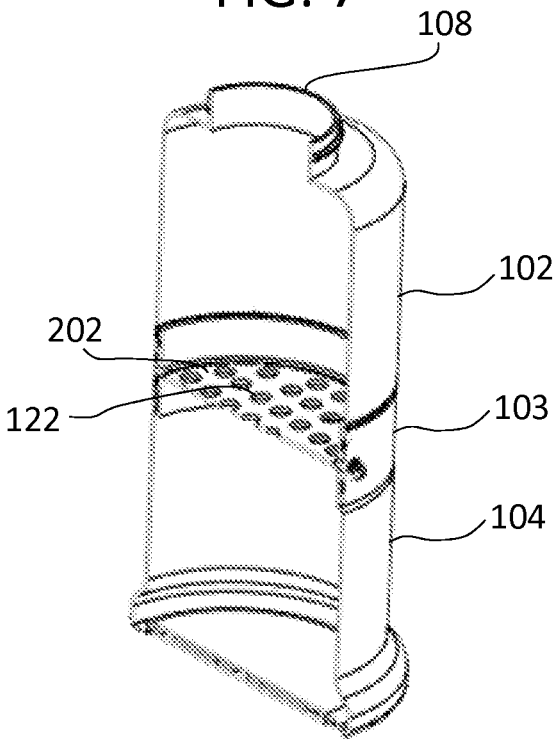
FIG. 7 is a cutaway view of the container of FIG. 1A along the line Y-Y, with a partitioning disk in place.

In FIG. 7 a second style partitioning disk 202, with openings 122, is seen in a sectional view of a container that could have a liquid in the entire cavity and ice cubes restricted to the base cylinder 104 in order to keep them from blocking the dispensing opening 108 during drinking.

Figure 8:
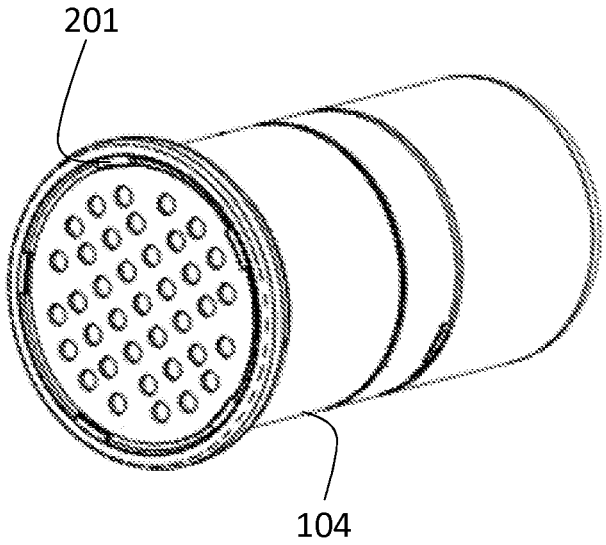
FIG. 8 is a perspective view of the container of FIG. 1A, showing the bottom of the base and illustrating a retention feature for unused partitioning discs.

When not in use, the partitioning disks can snap into a retention depression 201 in the base of the container as seen in FIG. 8.

Variations on the First Example

Of course a container consistent with these teachings might be of a smaller or larger size. Embodiments might have a non-uniform cross sectional profile. A variety of dispensing openings and closures are possible. Various latch schemes might be employed. While the upper cylinder and lower cylinder are shown as approximately the same volume, other versions of containers might have either of the containers segments smaller than the other.

Figure 9:
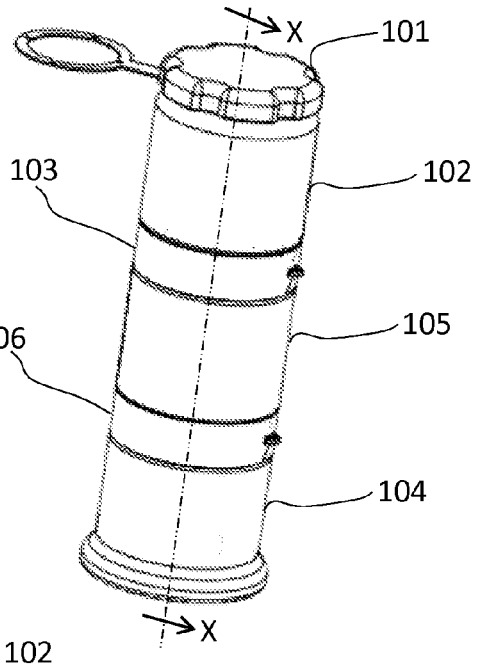
FIG. 9 is an alternative version of a container that includes three sections.
Figure 10:
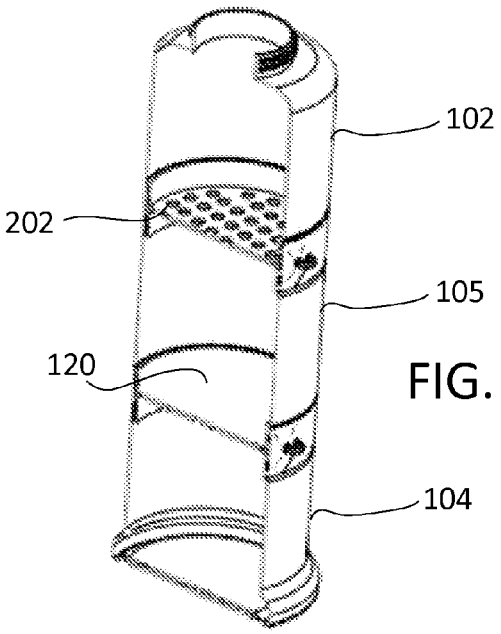
FIG. 10 is the container of FIG. 9 in cutaway at the line X-X, showing two partitions inserted.

As seen in FIG. 9, versions of containers consistent with these teachings can have more than two cylindrical segments. In addition to an upper cylinder 102 and a base cylinder 104, FIG. 9 shows a central cylinder 105 and a second coupling ring 106. With all portions assembled, a large capacity container is formed. A user could readily reconfigure the container of FIG. 9 to that of the first example container. Partitions 120 could be employed to separate the container of FIG. 9 into two chambers or into three chambers depending on the user's needs at the time as seen in FIG. 10.

Figure 11:
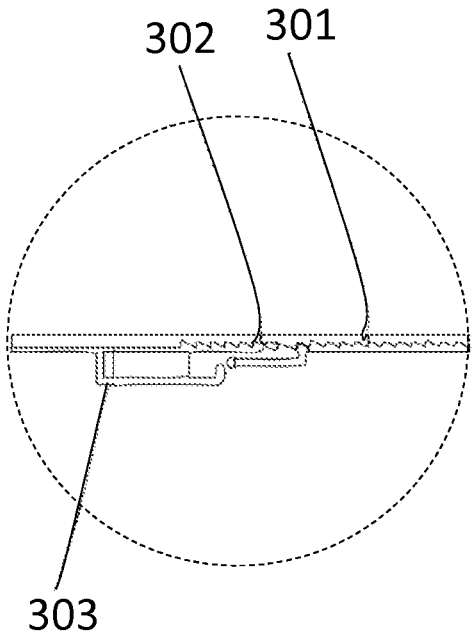
FIG. 11 is an expanded partial view of the area W of FIG. 1B, showing the latch area.
Figure 12A:
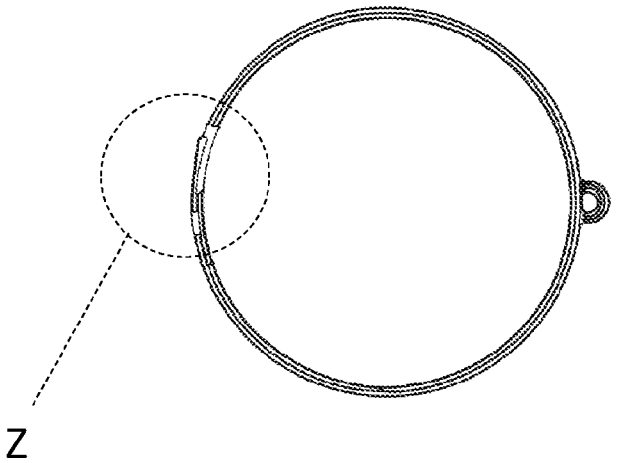
FIG. 12A is a plan view of the coupling ring.
Figure 12B:
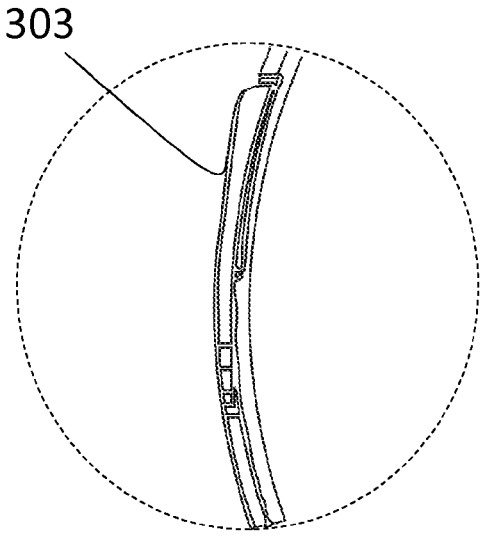
FIG. 12B is an enlarged partial view of the area Z of FIG. 12A.

Details of the latch are shown in the expanded view of FIG. 11. The teeth on the upper portion of the bottle 301 are engaged with the teeth 302 of the coupling ring. The teeth can be mutually disengaged by applying pressure to the "bump" 303. Another expanded view of the latch is seen in FIG. 12B, an enlargement of the area Z of FIG. 12A.

Second Example Container

Figure 14:
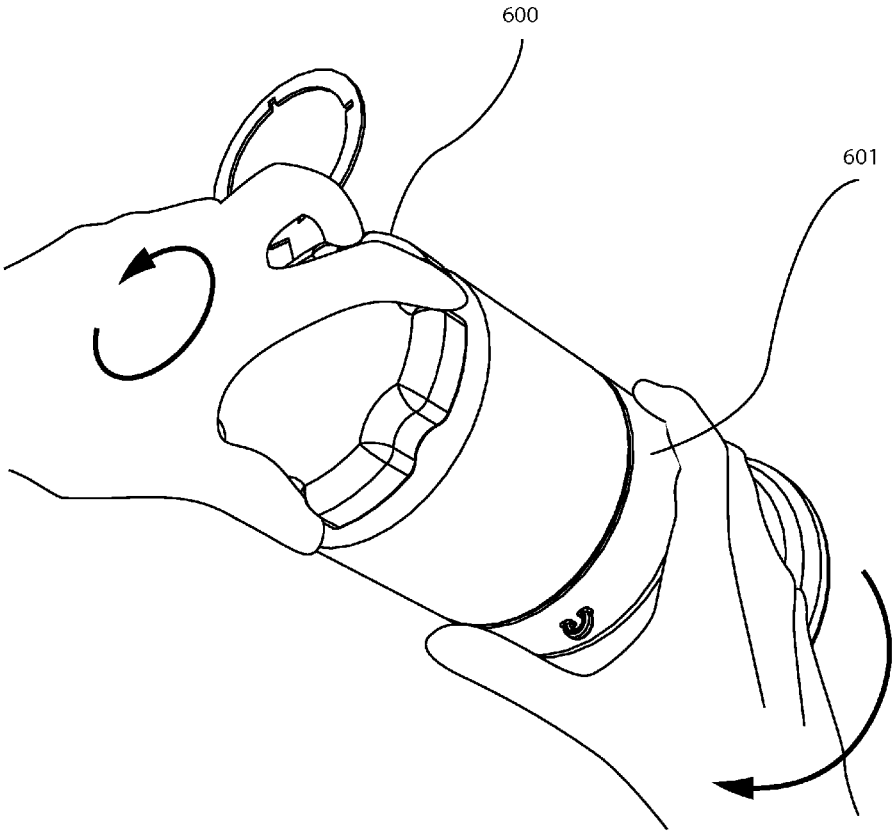
FIG. 14 shows a multi-segment container with a cap-opening force being applied by a user.
Figure 15A:
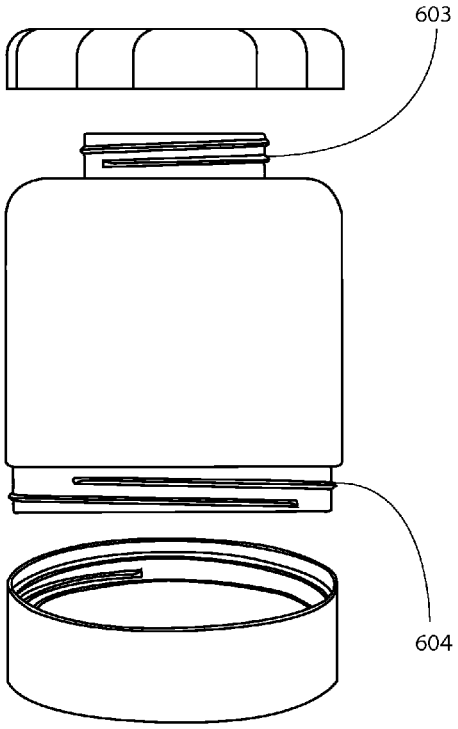
FIG. 15A shows a container with a right hand threaded cap and a left hand threaded coupler joint.
Figure 15B:
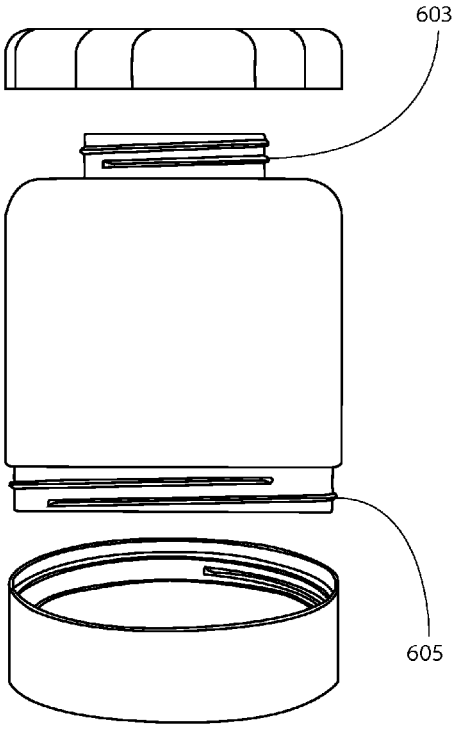
FIG. 15B shows a container with a right hand threaded cap and a right-hand threaded coupler joint.

If a user attempts to unscrew a threaded cap 600 while grasping a container by a lower segment 601 as seen in FIG. 14, the force might unscrew the segments from each other rather than remove the cap. This can be avoided by having a left-handed thread 604 at the segment to coupler connection as seen in FIG. 15A rather than both connections being right-handed 603 605 as in FIG. 158.

Figure 13A:
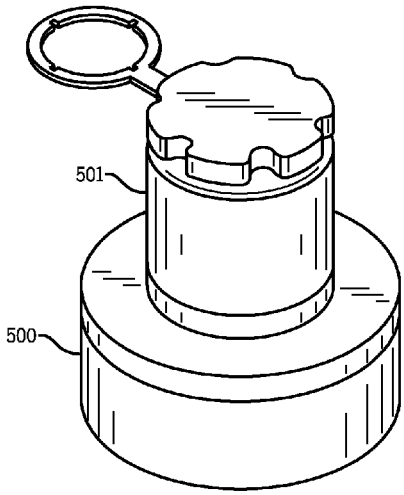
FIG. 13A illustrates an alternative embodiment with distinctly different diameter sections.
Figure 13B:
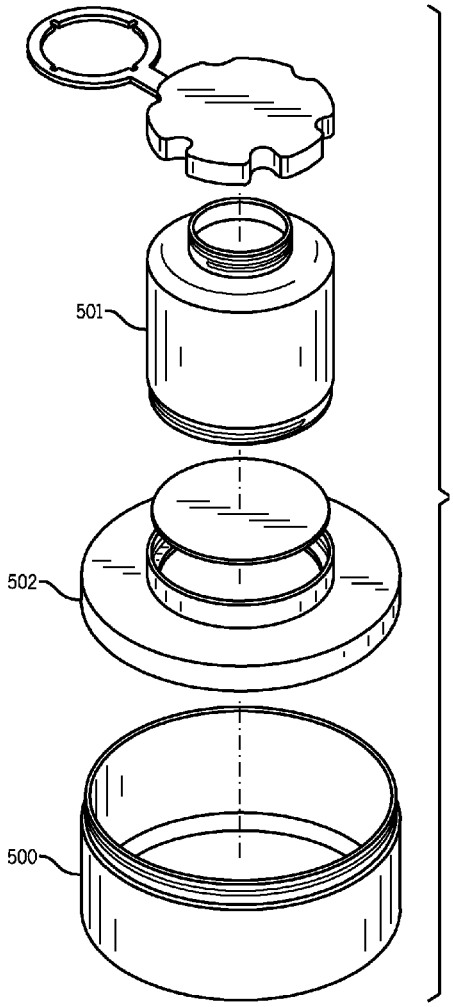
FIG. 13B is the device of FIG. 13A, exploded.

A second embodiment is seen in FIGS. 13A and 13B. In this example the two cylindrical chambers are of distinctly different diameters. Some versions with differing diameters can differ by about a factor of 1.1 times to a factor of about 3 times. Since the upper and lower portions are of different diameters, the connecting annular ring 502 has corresponding smaller and larger diameter threaded interfaces. A unit if this type might be used to hold a solid food item, possibly a cookie in the lower portion 500 while storing milk in the upper portion 501.

Variations

The joints of a coupling ring in an alternate version can require distinct opening forces by being threaded with different "handedness". Alternatively one joint could use a bayonet connection to the coupling ring 203 (not shown in these drawings) while the other joint uses a threaded connection. Disconnecting one portion in that case would require pushing and turning. Disconnecting the other portion would take a twisting motion. Another alternate structure would be to have both joints threaded with the same handedness but with one joint requiring notably more force to operate—possibly by a slight cross threading. In these alternate versions there is no need for explicit latches to operate in opening.

As used in this document the terms upper and lower are in reference to a container standing perpendicularly to the ground with its openable end facing away from the ground.

Those skilled in the art will be aware of materials, techniques and equipment suitable to produce the example embodiments presented as well as variations on the those examples. This teaching is presented for purposes of illustration and description but is not intended to be exhaustive or limiting to the forms disclosed. Many modifications and variations will be apparent to those of ordinary skill in the art. The embodiments and versions help to explain the principles of the invention, the practical application, and to enable others of ordinary skill in the art to understand it. Various embodiments with various modifications as are suited to the particular application contemplated are expected.

In the following claims, the words "a" and "an" should be taken to mean "at least one" in all cases, even if the wording "at least one" appears in one or more claims explicitly. The scope of the invention is set out in the claims below.

It is claimed:

1. A partition system for a multi-chamber container comprising:

a) at least two circular, blocking discs of the same predetermined diameter where at least a first disc blocks the passage of solids and blocks the flow of a fluid and at least a second disc blocks the passage of some solids and permits the flow of the fluid;

b) at least two cylindrical container portions, each having a respective open end leading to a respective cavity;

the container portions being mutually threadably, coupleable, via a coupling portion, at their openings such as to capture a blocking disc in an operable, interposed orientation to intercept flow between the cavities.

2. The partition system of claim 1 where the first disc is solid and the second disc has a plurality of apertures.

3. The partition system of claim 1 where at least one disc is plastic.

4. The partition system of claim 1 where the coupling portion comprises an annular ring.

* * * * *